US011453829B2

(12) United States Patent
Bertino-Ghera et al.

(10) Patent No.: US 11,453,829 B2
(45) Date of Patent: Sep. 27, 2022

(54) PROCESS FOR IMPROVING THE PRODUCTION OF BENZENE AND TOLUENE

(71) Applicant: IFP Energies nouvelles, Rueil-Malmaison (FR)

(72) Inventors: Celine Bertino-Ghera, Corbas (FR); Alexandre Pagot, St Genis Laval (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 11 days.

(21) Appl. No.: 16/767,939

(22) PCT Filed: Nov. 16, 2018

(86) PCT No.: PCT/EP2018/081582

§ 371 (c)(1),
(2) Date: May 28, 2020

(87) PCT Pub. No.: WO2019/105767

PCT Pub. Date: Jun. 6, 2019

(65) Prior Publication Data

US 2020/0369970 A1 Nov. 26, 2020

(30) Foreign Application Priority Data

Nov. 29, 2017 (FR) ..... 1761373

(51) Int. Cl.
*C10G 59/06* (2006.01)
*C10G 59/00* (2006.01)

(52) U.S. Cl.
CPC ..... *C10G 59/06* (2013.01); *C10G 2300/1096* (2013.01); *C10G 2400/30* (2013.01)

(58) Field of Classification Search
CPC ..... C10G 59/00; C10G 59/06; C10G 2300/1096; C10G 2400/30
See application file for complete search history.

(56) References Cited

U.S. PATENT DOCUMENTS 6,051,128 A 4/2000 Nacamuli et al.
2006/0021914 A1* 2/2006 Sanchez ..... C10G 35/04 208/308
2012/0277505 A1 11/2012 Serban et al.
2017/0015913 A1 1/2017 Pagot

OTHER PUBLICATIONS

International Search Report PCT/EP2018/081582 dated Jan. 21, 2019 (pp. 1-2).

* cited by examiner

*Primary Examiner* — In Suk C Bullock
*Assistant Examiner* — Jason Y Chong
(74) *Attorney, Agent, or Firm* — Millen, White, Zelano and Branigan, P.C.; Harry B. Shubin

(57) ABSTRACT

The invention relates to a process for the production of C6-C7 aromatic compounds from a hydrocarbon feedstock of naphtha type comprising a step of fractionating (2) the feedstock in order to obtain an upper stream and a lower stream, a step of catalytic reforming of the upper stream (6) and of the lower stream (9), a step of recombining (15) the reformate effluents obtained, a step of recontacting (16) and a step of stabilizing (19) the stabilized reformate effluents and a step of separating (22) the raffinate in order to recover C6 and C7 hydrocarbon compounds.

16 Claims, 4 Drawing Sheets

PROCESS FOR IMPROVING THE PRODUCTION OF BENZENE AND TOLUENE

TECHNICAL FIELD

The present invention relates to the field of processes for the production of aromatic compounds and more particularly aromatic compounds of benzene, toluene and xylene type by catalytic reforming of a hydrocarbon feedstock of naphtha type.

STATE OF THE ART

Generally, the objective of a catalytic reforming unit is to convert naphthenic and paraffinic (n-paraffin and isoparaffin) compounds into aromatic compounds. The main reactions involved are the dehydrogenation of naphthenes and the dehydrocyclization of paraffins to give aromatics, the isomerization of paraffins and of naphthenes. Other "side" reactions can also take place, such as the hydrocracking and the hydrogenolysis of paraffins and of naphthenes, the hydrodealkylation of alkylaromatics, giving rise to light compounds and lighter aromatics, as well as the formation of coke at the surface of the catalysts.

The feedstocks typically sent to a catalytic reforming unit are rich in paraffinic and naphthenic compounds and relatively poor in aromatic compounds. They are generally naphthas resulting from the distillation of crude oil or natural gas condensates. Other feedstocks may also be available, containing variable contents of aromatics, namely heavy catalytic cracking naphthas, heavy coker naphthas, heavy hydrocracking naphthas, or also steam cracking petrols.

For application in petrochemistry, the performance qualities desired are the yield of aromatics and also the distribution of the aromatics produced. Aromatic compounds are generally processed in an aromatic complex in order to maximize the production of one or more products, generally xylenes and benzene. Toluene and the heavier aromatics can be upgraded in order to form petrol bases or by the production of a mixture of xylenes. The production of C6-C7 aromatic compounds makes it possible in particular to improve the octane number of the petrol and/or makes it possible to increase the supply of benzene, of toluene and of xylenes. In order to maximize the production of C6-C7 aromatic compounds by catalytic reforming, the presence of a specific catalytic system generally comprising a catalytically active metal (generally platinum) and a non-acid zeolite is used.

There exist many known processes which have the aim of maximizing the production of C6-C7 aromatic compounds. For example, Patent Application US2012/0277505 discloses a process for improving the production of benzene and toluene from a feedstock of naphtha type comprising the following stages:

- a naphtha stream is sent into a fractionation unit, generating a first stream comprising C7 and lighter hydrocarbons and a second stream comprising heavier hydrocarbons;
- the first stream is sent into a first reforming unit, generating a first effluent;
- the second stream is sent into a second reforming unit, at a temperature greater than the temperature applied in the first reforming unit, generating a second effluent;
- the first effluent and the second effluent are sent into a reformate separation column, thus creating a top stream and a bottom stream;

- the top stream is sent into a unit for the purification of aromatic compounds, thus creating a purified stream of aromatics comprising C6 and C7 aromatic compounds, and a raffinate stream;
- the raffinate stream is recycled in the first reforming unit.

Such a process makes possible an increased production of aromatic hydrocarbons, and in particular of benzene and of toluene, from a naphtha feed stream. More particularly, the stage of recycling the raffinate and the repositioning of the unit for extraction of aromatics, with respect to the two catalytic reforming units located in parallel, makes it possible to generate an increase of 25% in the benzene yields and an increase of approximately 10% in the toluene yields.

Similarly, patent U.S. Pat. No. 6,051,128 discloses a process for catalytic reforming of a naphtha-type hydrocarbon feedstock, the objective of which is to increase the production of xylene and benzene.

However, although these processes aim to improve the production of aromatic compounds, this often takes place at the expense of the production of lighter compounds, in particular C3 and C4 hydrocarbon compounds which are upgradeable. The presence of C3 and C4 hydrocarbons in the effluents of the catalytic reforming is notably linked to the hydrocracking reactions which take place concomitantly with the dehydrogenation reactions. Likewise, the recovery and the purification of the hydrogen contained in the reformate effluents are not dealt with in the prior art.

One objective of the invention is to provide a catalytic reforming process that makes it possible to improve the recovery of benzene and toluene, while maximizing the recovery of hydrogen and of the C3 and C4 hydrocarbons which may be better upgraded compared to a simple consumption as fuels in the refinery and which is more economical from an energy point of view.

Subjects of the Invention

One subject of the present invention is a process for the production of C6-C7 aromatic compounds, notably benzene, toluene (and even optionally C8 xylene), from a hydrocarbon feedstock of naphtha type comprising the following steps:

a) said feedstock is sent into a first fractionation unit in order to obtain an upper stream predominantly comprising C6 and C7 hydrocarbon compounds and a lower stream predominantly comprising C8 to C10 hydrocarbon compounds;
b) the upper stream is sent into a first catalytic reforming unit in order to obtain a first reformate effluent;
c) the lower stream is sent into a second catalytic reforming unit in order to obtain a second reformate effluent;
d) the first reformate effluent and the second reformate effluent are combined and the combined reformate stream is sent into a recontacting section in order to obtain a first gaseous effluent rich in hydrogen and a liquid effluent of hydrocarbons;
e) the hydrocarbon effluent is sent into a stabilization section in order to recover a second gaseous effluent enriched in C1 and C2 hydrocarbon compounds, a liquid phase predominantly containing C3 and C4 hydrocarbons and a liquid fraction predominantly comprising hydrocarbon compounds having at least four carbon atoms;
f) said liquid fraction is sent into a reformate separation column in order to obtain an overhead stream comprising C6 and C7 hydrocarbon compounds and a bottom stream comprising hydrocarbon compounds having at least eight carbon atoms.

In one embodiment according to the invention, the process further comprises a step g) in which the overhead stream obtained in step f) is sent into a unit for extraction of the aromatics in order to form a stream predominantly comprising C6-C7 aromatic compounds and a raffinate stream.

Preferably, said raffinate stream is recycled to step b) upstream of said first catalytic reforming unit.

In one particular embodiment according to the invention, step d) of the process comprises the following substeps:

i) the combined reformate stream is separated into a gaseous phase and a liquid phase containing hydrocarbons;

ii) the liquid phase resulting from step i) is cooled to a temperature below or equal to 45° C. by means of a cooling device;

iii) a first recontacting of the liquid phase cooled with the gaseous phase is carried out in a separation means so as to recover a first gaseous effluent rich in hydrogen and a first liquid effluent of hydrocarbons;

iv) a second recontacting of the first liquid effluent of hydrocarbons with a recycle gas is carried out and a second gaseous effluent enriched in C1 and C2 hydrocarbons and a second liquid effluent of hydrocarbons are separated;

v) the second liquid effluent of hydrocarbons resulting from step iv) is fractionated in a fractionating column so as to separate an overhead gaseous fraction and a bottom liquid fraction containing hydrocarbons having at least 4 carbon atoms;

vi) the overhead gaseous fraction resulting from step v) is condensed and a liquid phase predominantly containing C3 and C4 hydrocarbons and a gaseous phase which is recycled to step iv) are separated.

The term "predominantly" is understood to mean, throughout the present text, the fact that the stream under consideration comprises, by weight, at least 50% of the components under consideration, in particular at least 80%, in particular at least 90% or 95%, by weight, of said components. This may also be all of the components under consideration, apart from the usual impurities.

Advantageously, the separation means is a recontacting column operating counter-currently or a scrubber.

Advantageously, before the cooling step ii), the liquid phase resulting from step i) is precooled by heat exchange in an exchanger fed with the first gaseous effluent and/or the first liquid effluent of hydrocarbons resulting from step iii).

Advantageously, before the cooling step ii), the liquid phase resulting from step i) undergoes heat exchange in an exchanger fed with the first gaseous effluent and in which the gaseous phase resulting from step i) undergoes heat exchange in an exchanger fed with the first liquid effluent of hydrocarbons.

Advantageously, before the cooling step ii), the liquid phase resulting from step i) undergoes heat exchange in an exchanger fed with the first liquid effluent of hydrocarbons and in which the gaseous phase resulting from step i) undergoes heat exchange in an exchanger fed with the first gaseous effluent.

Preferably, a portion or all of the second gaseous effluent enriched in C1 and C2 hydrocarbons is recycled before the first recontacting step.

Advantageously, the second gaseous effluent is recycled as a mixture with the gaseous phase resulting from step i).

Preferably, between steps a) and b), a step of hydrodesulfurization of the upper stream and/or of the lower stream is carried out in a hydrotreating unit.

Advantageously, the catalytic reforming step b) or step c) is carried out at a temperature of between 400° C. and 600° C., a pressure of between 0.1 and 3 MPa, a molar ratio of the hydrogen to the hydrocarbon compounds of the upper stream or the hydrocarbon compounds of the lower stream of between 0.8 and 8 mol/mol, and a mass flow rate of treated stream per unit of mass of catalyst and per hour is between 1 and 10 $h^{-1}$.

Preferably, the catalyst used in step b) comprises an active phase comprising at least one metal chosen from platinum, zinc or molybdenum, and a support comprising a zeolite chosen from a zeolite L, a zeolite X, a zeolite Y or a zeolite ZSM-5, and optionally a binder chosen from aluminosilicates, alumina, silica, clays or silicon carbides, taken alone or in combination.

More preferentially, the zeolite is a zeolite L and the binder is silica.

Advantageously, the catalyst used in step c) comprises an active phase comprising at least one metal chosen from nickel, ruthenium, rhodium, palladium, iridium or platinum, at least one promoter chosen from rhenium, tin, germanium, cobalt, nickel, iridium, rhodium or ruthenium, and a support based on alumina, on silica/alumina or on silica.

DETAILED DESCRIPTION OF THE INVENTION

Definitions

Figure 1:
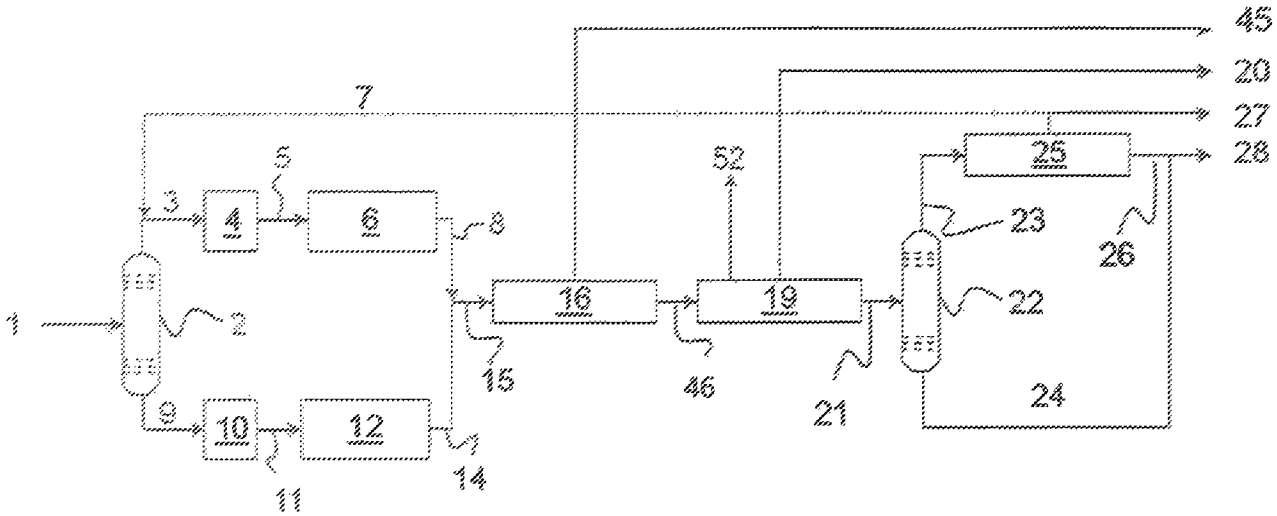
FIG. 1 is a simplified diagrammatic representation of the process according to the invention.

Hereinbelow, the groups of chemical elements are given according to the CAS classification (CRC Handbook of Chemistry and Physics, published by CRC Press, Editor in Chief D. R. Lide, 81st edition, 2000-2001). For example, group IB according to the CAS classification corresponds to the metals of column 11 according to the new IUPAC classification.

The term "recontacting section" is understood to mean a section comprising an operation that makes it possible to extract compounds contained in a gaseous phase by means of a liquid phase which has an absorption capacity owing to a contacting between the two phases. For example, recontacting may be achieved by carrying out direct contact by inline mixing of the liquid and gaseous phases or in a recontacting device dedicated to the unit operation.

The term "stabilized" for a reformate denotes a reformate that has been distilled to remove most, and generally substantially all, of the compounds having 4 carbon atoms or less ($C_{4-}$).

$C_n$ hydrocarbon cut is understood to mean a cut comprising hydrocarbons having n carbon atoms.

$C_{n+}$ cut is understood to mean a cut comprising hydrocarbons having at least n carbon atoms.

$C_{n-}$ cut is understood to mean a cut comprising hydrocarbons having at most n carbon atoms.

DESCRIPTION

The present invention relates to a process for the production of aromatic compounds, preferably C6-C7 aromatic compounds, and in particular benzene and toluene (and optionally C8 xylene), from a naphtha cut predominantly comprising C6 to C10 hydrocarbons. According to the invention, the process comprises the following steps:

a) said feedstock is sent into a first fractionation unit in order to obtain an upper stream predominantly comprising C6 and C7 hydrocarbon compounds and a lower stream predominantly comprising C8 to C10 hydrocarbon compounds;
b) the upper stream is sent into a first catalytic reforming unit in order to obtain a first reformate effluent;
c) the lower stream is sent into a second catalytic reforming unit in order to obtain a second reformate effluent;
d) the first reformate effluent and the second reformate effluent are combined and the combined reformate stream is sent into a recontacting section in order to obtain a first gaseous effluent rich in hydrogen and a liquid effluent of hydrocarbons;
e) the hydrocarbon effluent is sent into a stabilization section in order to recover a second gaseous effluent enriched in C1 and C2 hydrocarbon compounds, a liquefied petroleum gaseous stream and a liquid fraction predominantly comprising hydrocarbon compounds having at least 4 carbon atoms (C4+);
f) said liquid fraction is sent into a reformate separation column in order to obtain an overhead stream comprising C6 and C7 hydrocarbon compounds and a bottom stream comprising hydrocarbon compounds having at least 8 carbon atoms (C8+);
g) optionally, the overhead stream is sent into a unit for extraction of the aromatics in order to form a stream predominantly comprising C6-C7 aromatic compounds, and a raffinate stream.

The process according to the invention advantageously uses the frigories contained in the gaseous or liquid effluents generated in the recontacting step carried out in a recontacting (or absorption) column in order to precool the liquid hydrocarbon phase before the latter is subjected to cooling that makes it possible to reach the temperature desired for the recontacting step. The thermal integration thus makes it possible to notably reduce the consumption of cold utility and therefore the overall energy consumption of the process. This thermal integration is even more advantageous since the liquid hydrocarbon phase must be cooled to a temperature below or equal to 10° C., this cooling then necessitating the use of a refrigerating unit which is an energy-consuming device.

The two catalytic reforming steps are carried out under operating conditions adjusted to promote the dehydrocyclization reactions and in order to limit the side reactions. The pressure used is generally between 0.1 and 3 MPa, and the hydrogen/hydrocarbons $H_2$/HC molar ratio is generally between 0.8 and 8 mol/mol. The temperature is generally between 400° C. and 600° C., preferably between 470° C. and 570° C. The mass flow rate of the stream to be treated per unit of mass of catalyst and per hour is generally between 0.1 and 10 $h^{-1}$, preferably between 0.5 and 6 $h^{-1}$.

In the context of the process according to the invention, the first catalytic reforming unit, into which a stream predominantly comprising C6 and C7 hydrocarbon compounds is sent, preferably comprises a catalyst comprising an active phase comprising at least one metal chosen from platinum, zinc or molybdenum, taken alone or as a mixture, and a support comprising a zeolite and optionally a binder. More preferentially, the metal is platinum.

Typically, the catalyst contains an amount of metal of between 0.02% and 2% by weight, preferably between 0.05% and 1.5% by weight and more preferably still between 0.1% and 0.8% by weight, with respect to the total weight of the catalyst.

More particularly, the zeolite is chosen from a zeolite L, a zeolite X, a zeolite Y or a zeolite ZSM-5. More preferentially, the zeolite is a zeolite L.

Preferably, the binder is chosen from aluminosilicates, alumina, silica, clays or silicon carbides, taken alone or in combination. More preferentially, the binder is chosen from silica.

The catalyst can also comprise at least one dopant metal selected from the group formed by gallium, gold, nickel, rhenium, barium, silver, iron, bismuth, indium, yttrium and the lanthanides (cerium, dysprosium, ytterbium), taken alone or as a mixture. The content of each dopant metal is, with respect to the total weight of the catalyst, between 0 and 2% by weight, preferably 0.01% and 1% by weight, preferably between 0.01% and 0.7% by weight, with respect to the total weight of the catalyst.

The catalyst can also comprise at least one halogen used to acidify the alumina support. The halogen content can represent between 0.1% and 15% by weight, with respect to the total weight of the catalyst, preferably 0.2% and 5%, with respect to the total weight of the catalyst.

Preferably, just one halogen, in particular chlorine or fluorine, is used. When the catalyst comprises just one halogen, which is chlorine or fluorine, the chlorine content is between 0.5% and 2% by weight, with respect to the total weight of the catalyst.

The catalyst can also comprise an alkali metal in proportions of the order of 0.1% to 3% by weight, with respect to the total weight of the catalyst. Preferably, the alkali metal is potassium.

In the context of the process according to the invention, the second catalytic reforming unit, into which a stream predominantly comprising C8 to C10 hydrocarbon compounds is sent, preferably comprises a catalyst with an active phase comprising at least one metal chosen from nickel, ruthenium, rhodium, palladium, iridium or platinum, and at least one promoter chosen from rhenium, tin, germanium, cobalt, nickel, iridium, rhodium or ruthenium. Preferably, the catalyst comprises an active phase comprising platinum and tin.

The amount of metal is between 0.02% and 2% by weight, preferably between 0.05% and 1.5% by weight and more preferably still between 0.1% and 0.8% by weight, with respect to the total weight of the catalyst.

Preferably, the catalyst comprises a chosen support based on alumina, on silica/alumina or on silica. Preferably, the support is based on alumina. The alumina(s) of the porous support used in the catalyst are of $\chi$, $\eta$, $\gamma$ or $\delta$ type. Preferably, they are of $\gamma$ or $\delta$ type. More preferably still, they are of $\gamma$ type.

Figure 2:
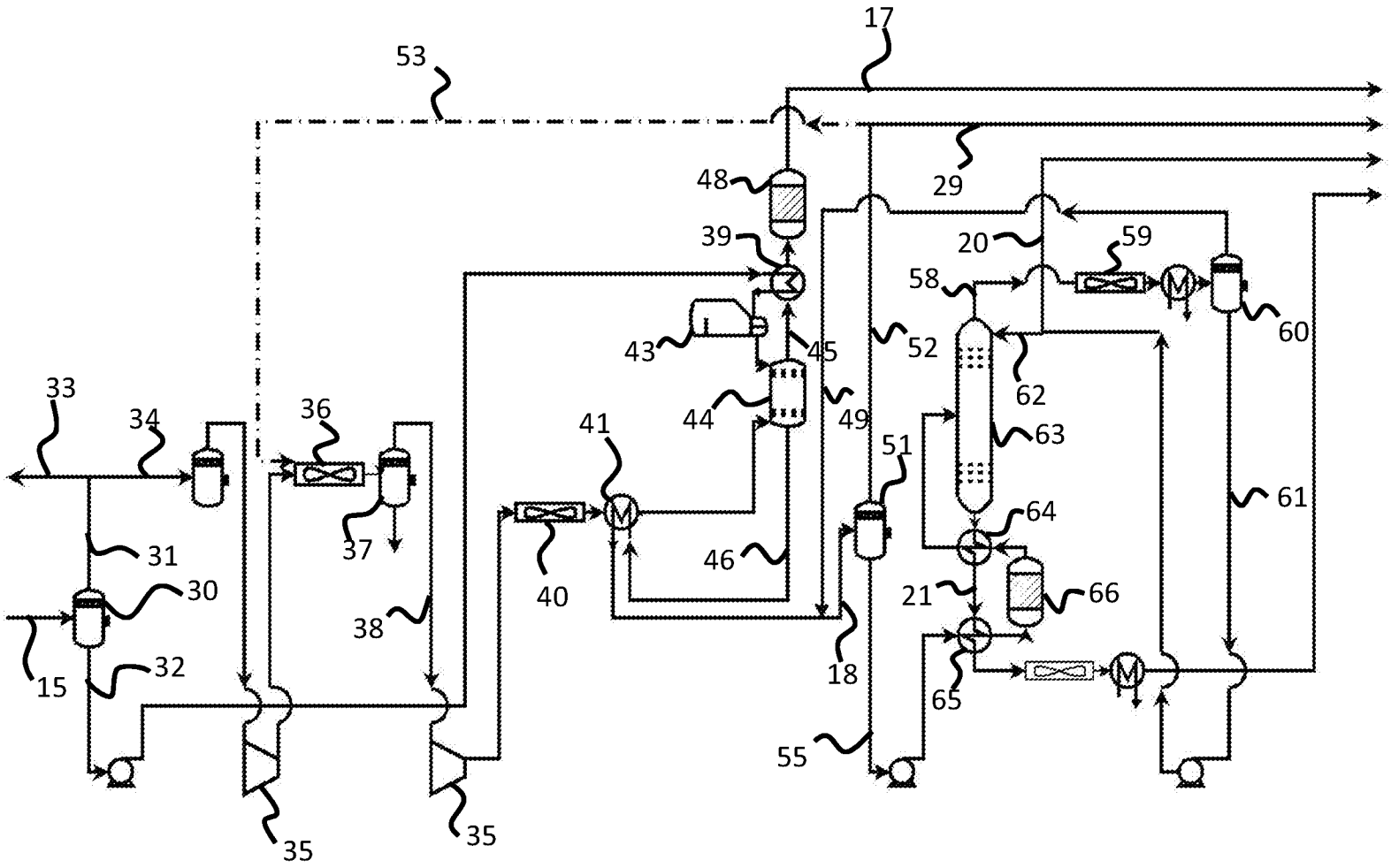
FIG. 2 is a diagrammatic representation of the recontacting and stabilizing sections represented in FIG. 1 according to a first embodiment according to the invention.
Figure 3:
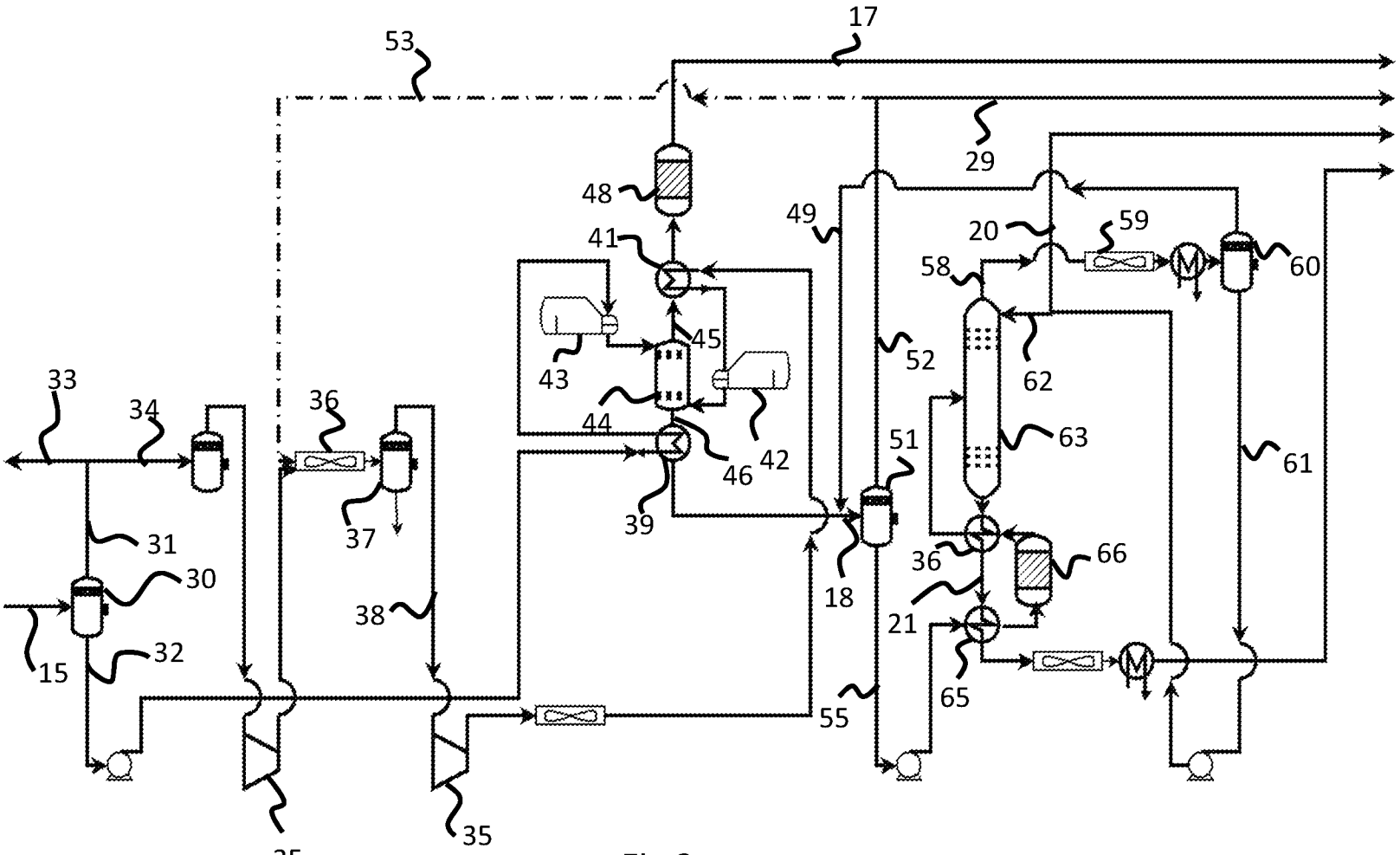
FIG. 3 is a diagrammatic representation of the recontacting and stabilizing sections represented in FIG. 1 according to a second embodiment according to the invention.

The invention will now be illustrated on the basis of FIGS. 1 to 3, which exhibit particularly advantageous embodiments.

With reference to FIG. 1, which nonlimitingly illustrates the process according to the invention, a feedstock 1 of naphtha type comprising C6 to C10 hydrocarbons is sent into a separation column 2 in order to obtain an upper stream 3 predominantly comprising C6 and C7 hydrocarbon compounds and a lower stream 9 predominantly comprising C8 to C10 compounds. The lower stream 9 comprises less than 10% by volume of C7-compounds. The upper stream 3 is sent into a hydrodesulfurization (hydrotreating) unit 4 and then the hydrodesulfurized upper stream 5 is sent into a first catalytic reforming unit 6, comprising a catalyst comprising an active phase based on platinum and a zeolite-type support. The operating conditions in the first reforming unit 6 are as follows: the temperature is between 400° C. and 600° C., the pressure is between 0.3 and 2.5 MPa, the molar ratio of the hydrogen to the hydrotreated upper stream 5 is between 0.8 and 8 mol/mol, and the mass flow rate of stream to be treated per unit of mass of catalyst and per hour is between 1 and 10 $h^{-1}$. The lower stream 9 is sent into a hydrodesulfurization (hydrotreating) unit 10 and then the hydrodesulfurized lower stream 11 is sent into a second catalytic reforming unit 12, comprising a bifunctional catalyst comprising an active phase based on platinum and on tin (Pt—Sn) supported on alumina. The operating conditions in the second reforming unit 12 are as follows: the temperature is between 400° C. and 600° C., the pressure is between 0.3 and 2.5 MPa, the molar ratio of the hydrogen to the hydrotreated lower stream 11 is between 0.8 and 8 mol/mol, and the mass flow rate of stream to be treated per unit of mass of catalyst and per hour is between 1 and 10 $h^{-1}$.

The first reformate 8 resulting from the first reforming unit 6 and the second reformate 14 resulting from the second reforming unit 12 are then combined together to form a reformate stream 15 which is then sent into a recontacting section 16 (described in detail below) in order to form a first gaseous effluent 45 rich in hydrogen, and a liquid hydrocarbon effluent 46. The liquid hydrocarbon effluent 46 is sent into a stabilization section 19 (described in detail below) in order to recover a second gaseous effluent 52 enriched in C1 and C2 hydrocarbons, a liquefied petroleum gas (LPG) stream 20 and a liquid fraction 21 predominantly containing hydrocarbons containing at least 4 carbon atoms. The liquid fraction 21 is then sent into a reformate separation column 22 in order to obtain an overhead stream 23 comprising C6 to C7 compounds and a bottom stream 24 comprising C8+ aromatic compounds. The overhead stream 23 is sent into a unit for extraction of the aromatics 25 in order to form a purified stream of aromatic compounds 26 and a raffinate stream 27 comprising aliphatic compounds, a portion of which can be recycled upstream of the first reforming unit 6 via the line 7. The streams 24 and 26 may then be recombined to form a stream 28 of aromatic compounds.

With reference to FIG. 2, which nonlimitingly illustrates the recontacting section 16 and the stabilization section 19 of the process according to the invention, the reformate stream 15 is sent into a gas-liquid separation device 30 which may be a gas-liquid scrubber known to a person skilled in the art. The separation device 30 makes it possible to recover a gaseous phase 31 and a liquid hydrocarbon phase 32, respectively at the top and bottom of said device 30. As indicated in FIG. 2, the gaseous overhead fraction 31 which predominantly contains hydrogen and C1, C2, C3 and C4 light hydrocarbons can be split into two streams 33 and 34. The stream 33 is recycled as recycle gas to a reaction unit located upstream, such as the catalytic reforming unit 6. As regards the gas stream 34, it is compressed using the compressor 35 and then sent into a cooling system 36. The gas 34 is typically compressed to a pressure between 0.6 and 1.0 MPa. The compressed gas 34 is optionally mixed with a recycle gas, transported by the line 53, the origin of which is described in detail below. The gas or gas mixture is cooled for example to a temperature below 55° C. The gas or gas mixture resulting from the cooling system 36 (for example an air or water cooler) is transferred into a scrubber 37 in order to recover a gas 38 purified of liquid hydrocarbons which are condensed by cooling. The cooled gas 38 is compressed using the compressor 35 to a pressure generally of between 1.6 and 4.0 MPa. The compressed gas 38 is subjected to a low-temperature recontacting step in the presence of the liquid hydrocarbon phase 32 resulting from the gas-liquid separation device 30. As represented in FIG. 2, the compressed gas is firstly precooled using an (air or water) cooler 40, then undergoes indirect heat exchange by means of an exchanger 41 which is fed by a cold stream described below. The gas may then advantageously be cooled by means of a cooling device (not represented), for example a chiller, in order to bring the gas to a temperature below or equal to 0° C.

The liquid hydrocarbon phase 32 is used as absorbent liquid in the recontacting step. Thus, the liquid hydrocarbon phase 32 is firstly precooled by indirect heat exchange, via an exchanger 39 which is fed by a cold stream described below. The precooled liquid hydrocarbon phase 32 is then cooled to a temperature below or equal to 45° C. by means of a cooling device 43. Various types of cooling means may be used depending on the desired temperature. For example, use is made of an air or water cooler when the targeted temperature is between 20° C. and 45° C. The use of a chiller will be favoured when it is desired to cool the liquid hydrocarbon phase to a temperature below or equal to 20° C., preferably to a temperature between −10° C. and 20° C.

The gas 38 and the cooled liquid hydrocarbon phase 32 are brought into contact counter-currently in a recontacting (or absorption) column 44 which may comprise perforated or bubble plates, or any other contacting plate or else may be packed with structured packing elements or random packing elements (pall rings, raschig rings or others). The column may for example have a number of theoretical separation plates of between 5 and 15, preferably between 7 and 10. The recontacting consists in carrying out an absorption of the C1 to C4 hydrocarbons present in the gas by means of the cooled liquid hydrocarbon phase. Generally, depending on the temperature of the gaseous and liquid phases which are brought into contact in the column, the recontacting step is carried out at a temperature between −20° C. and 55° C., preferably between −10° C. and 10° C.

From the recontacting column 44, which is generally operated at a pressure of between 1.6 and 4.0 MPa, a hydrogen-rich gaseous effluent is drawn off via the line 45.

The cold gaseous effluent is used as thermal fluid for the exchanger 39 which carries out an indirect heat exchange with the liquid hydrocarbon phase 32, as described above.

The cold liquid effluent discharged through the bottom of the column 44 via the line 46 is also used as thermal fluid in order to supply the exchanger 41 to precool the gaseous phase 38.

The use of cold fluids resulting from the recontacting step makes it possible to notably reduce the energy consumption of the cooling devices 43 (cf. FIG. 2) and 42 (cf. FIG. 3) which are needed to carry out a cooling of the liquid hydrocarbon phase in order to increase its absorption capacity for being used as recontacting liquid fluid.

The hydrogen-rich gas 45 is discharged from the treatment unit via the line 17 after optionally passing through a guard bed 48 in order to adsorb the chlorine present in the gas when the hydrocarbon feedstock treated by the process is a catalytic reforming effluent.

According to the process, the liquid effluent 46 resulting from the recontacting column 44 is used as recontacting fluid in a second recontacting step which consists in bringing said liquid effluent into contact with a gaseous recycle fluid provided by the line 49, in order to improve the recovery of C3 and C4 compounds (LPG) and discharge the methane and ethane of the process.

As indicated in FIG. 2, the second recontacting is carried out by direct contact by inline mixing of the liquid effluent 46 with the recycle gas 49. The second recontacting step is carried out at a temperature above that of the first recontacting step, which is generally between 10° C. and 55° C. This temperature results from the thermodynamic equilibrium of the absorption of the liquid 46 and of the vapour 49. Preferably, no means for controlling the temperature (for example of heat exchanger type) is used.

The gas/liquid mixture is transferred by the line 18 into a scrubber 51 which is operated so as to maximize the recovery in the overhead gas of hydrogen and C1 and C2 hydrocarbons. The gaseous effluent containing hydrogen and C1 and C2 hydrocarbons is drawn off via the line 52 in order to be recycled in whole or in part in the process via the line 53. The portion of the gaseous effluent containing hydrogen and C1 and C2 hydrocarbons which is not recycled is discharged from the process via the line 29. This gaseous effluent may be used in particular as fuel gas in the refinery.

The recycling, in whole or in part, of the gaseous effluent containing hydrogen and C1 and C2 hydrocarbons upstream of the first recontacting step, for example as indicated in FIG. 2 as a mixture with the compressed gas 33 resulting from the scrubber 30 has the advantageous effect of improving the recovery yield of hydrogen during the first recontacting step.

With reference to FIG. 2, recovered through the bottom of the scrubber 51 is a liquid effluent 55 containing essentially hydrocarbons having three or more than three carbon atoms (C3+) and also a minority amount of C1 and C2 hydrocarbons. The liquid effluent 55 is heated before being sent to a stabilization unit which is operated so as to recover a stabilized liquid hydrocarbon effluent and a distillate comprising predominantly C3 and C4 hydrocarbons. The stabilization unit comprises a distillation column 63, the bottom of which is provided with a circulation duct equipped with a recirculation circuit comprising a reboiler (which are not represented) and with a duct 21 for discharging the stabilized liquid effluent. The overhead gas from the column 63 circulates in a duct 58 connected to a condensation system comprising a device 59 for cooling the overhead gas and a reflux drum 60. The condensed liquid separated in the reflux drum 60 is discharged via the line 61 and is split into two streams, one stream being recycled into the column 63 through the line 62 while the complementary non-recycled stream is discharged via the line 20 out of the process as an LPG stream. The residual gas drawn off at the top of the reflux drum 60, which is not condensed and potentially comprises significant amounts of C3 and C4 hydrocarbons, is discharged via the line 49 and recycled in the process in order to undergo a recontacting step with the liquid effluent 46 resulting from the recontacting column 44, as specified above.

Still with reference to FIG. 2, the stabilized liquid effluent 21 recovered at the bottom of the distillation column 63 is advantageously used to supply an indirect heat exchanger system 64, 65 in order to preheat the liquid effluent 55 before it enters the distillation column 63. This thermal integration thus makes it possible to reduce the heating power required by the reboiler to operate the distillation column 63.

As indicated in FIG. 2, it is advantageous to have, upstream of the distillation column 63, a guard bed 66 configured to capture the chlorine optionally present in the liquid effluent 55.

FIG. 3 represents a schematic diagram of the process according to the invention according to a second embodiment. The second embodiment differs from that of FIG. 2 in that, on the one hand, the liquid hydrocarbon phase 32 is precooled by heat exchange in an exchanger 39 fed with a cold fluid which is the liquid effluent 46 resulting from the recontacting column 44 and, on the other hand, in that the compressed gas 38 is precooled by indirect heat exchange using an exchanger 41 which is fed by the hydrogen-rich gaseous effluent 45 drawn off at the top of the recontacting column 44. This configuration makes it possible to more easily balance the flow rates of the gaseous and liquid effluents which feed the exchangers 39 and 41 depending on the requirements and/or availabilities of the frigories for precooling the gaseous and liquid phases which are brought into contact in the column.

EXAMPLES

The example that follows compares three process schemes: one scheme not in accordance with the invention comprising no shared recontacting and stabilization section for the two catalytic reforming reactors (cf. FIG. 4) and two schemes in accordance with the invention, including one scheme comprising no step of recycling the gaseous effluent containing hydrogen and C1 and C2 hydrocarbons (the whole of the gaseous effluent resulting from the bottom of the scrubber 51 is discharged from the process via the line 29, cf. FIG. 2 or 3), and one scheme comprising said recycling step (via the line 53, cf. FIG. 2 or 3).

For each scheme according to the prior art and according to the invention, the catalytic reforming units and the units for extraction of the aromatics are identical.

In all the cases, the feedstock under consideration is as follows:

density at 15° C.: 0.7284 kg/dm$^3$;

distribution of paraffins/naphthenes/aromatics: 65/22/13 wt %.

Example 1: Reforming Process According to the Prior Art

Figure 4:
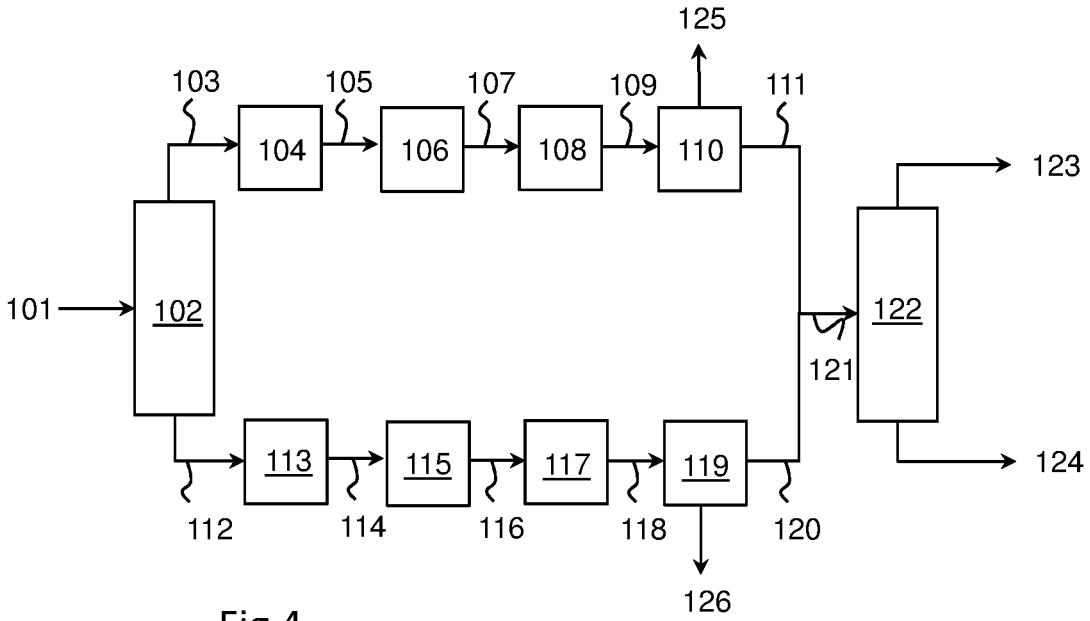
FIG. 4 is a diagrammatic representation of the process according to the prior art.

The scheme of the process according to the prior art corresponds to FIG. 4.

In the scheme according to the prior art, a naphtha-type feedstock 101 comprising C6 to C10 hydrocarbons is sent into a separation column 102 in order to obtain an upper stream 103 predominantly comprising C6 and C7 hydrocarbon compounds and a lower stream 112 predominantly comprising C8 to C10 compounds. The lower stream 112 comprises less than 10% by volume of C7-compounds. The upper stream 103 is sent into a hydrodesulfurization unit 104 and then the hydrodesulfurized upper stream 105 is sent into a first catalytic reforming unit 106, comprising a catalyst comprising an active phase based on platinum and a zeolite-type support. The operating conditions in the first reforming unit 106 are as follows: the temperature is between 400° C. and 600° C., the pressure is between 0.3 and 2 MPa, the molar ratio of the hydrogen to the hydrotreated upper stream 105 is between 1:1 and 10:1, and the mass flow rate of treated feedstock per unit of mass of catalyst and per hour is between 0.1 and 10 $h^{-1}$. The lower stream 112 is sent into a hydrodesulfurization unit 113 and then the hydrodesulfurized lower stream 114 is sent into a second catalytic reforming unit 115, comprising a bifunctional catalyst comprising an active phase based on platinum and on tin (Pt—Sn) supported on alumina. The operating conditions in the second reforming unit 115 are as follows: the temperature is between 400° C. and 600° C., the pressure is between 0.3 and 2.5 MPa, the molar ratio of the hydrogen to the hydrotreated lower stream 114 is between 1:1 and 10:1, and the mass flow rate of treated feedstock per unit of mass of catalyst and per hour is between 0.1 and 10 $h^{-1}$. The first reformate 107 resulting from the first reforming unit 106 and the second reformate 116 resulting from the second reforming unit 115 are then respectively each sent into a recontacting section 108 and 117 then the liquid hydrocarbon effluents 109 and 118 obtained are then sent into a stabilization column 110 and 119. The streams 125 and 126 predominantly comprising C5-hydrocarbon compounds are discharged from the process. The stabilized effluents 111 and 120 predominantly comprising C6+ hydrocarbon compounds are then combined together to form a reformate stream 121 which is then sent into a reformate separation column 122 in order to obtain an overhead stream 123 predominantly comprising C6 and C7 hydrocarbon compounds and a bottom stream 124 predominantly comprising C8+ hydrocarbon compounds. The overhead stream 123 is then sent into a unit for extraction of the aromatics similar to that used in the context of the process according to the invention in order to obtain a stream of aromatic compounds.

Example 2: Reforming Process According to the Invention (without Recycling)

The reforming process according to Example 2 corresponds to the process corresponding to FIGS. 1 and 2 in which the whole of the gaseous effluent resulting from the scrubber 51 is discharged from the process via the line 29.

The operating conditions of the reforming reactors and of the unit for extraction of the aromatics are identical to those of the prior art.

Example 3: Reforming Process According to the Invention (with Recycling)

The reforming process according to Example 3 corresponds to the process corresponding to FIGS. 1 and 2 in which the whole of the gaseous effluent resulting from the scrubber 51 is recycled upstream of the recontacting section via the line 53.

The operating conditions of the reforming reactors and of the unit for extraction of the aromatics are identical to those of the prior art.

For each of the examples above, the material balance for treating 4800 tonnes per day (t/d) of naphtha-type feedstock has been analysed and is given below (cf. Table 1).

TABLE 1

| Products (tonnes/day) | Example 1 (not in accordance with the invention) | Example 2 (in accordance with the invention) | Example 3 (in accordance with the invention) |
|---|---|---|---|
| $H_2$-rich gaseous effluent | 605 | 382 | 397 |
| $H_2$ in the $H_2$-rich gaseous effluent | 236 | 238 | 239 |
| C1-C2 | 16 | 28 | 0 |
| C3-C4 | 55 | 153 | 165 |
| C5 | 282 | 326 | 327 |
| C6-C7 | 1916 | 1976 | 1977 |
| C8+ | 1932 | 1939 | 1939 |
| Purity of $H_2$ in rich gas (wt %) | 39 | 62 | 62 |
| Purity of $H_2$ in rich gas (mol %) | 92.5 | 95.90 | 95.13 |

Table 1 shows that the process according to the invention (Examples 2 and 3), in which a step of recontacting the recombined reformate effluents is carried out, makes it possible to increase the recovery of C6 and C7 hydrocarbon compounds (1976 and 1977 tonnes/day respectively) while improving the recovery of C3 and C4 hydrocarbon compounds (153 and 165 tonnes/day respectively versus 55 tonnes/day in Example 1 according to the prior art) compared to a process not in accordance with the invention comprising no shared recontacting and stabilization section for the two catalytic reforming reactors. Furthermore, the process according to the invention makes it possible to recover hydrogen at a higher degree of purity (95.9 and 95.13 mol % respectively for Examples 2 and 3) than in the prior art (92.5 mol %).

The invention claimed is:

1. A process for the production of C6-C7 aromatic compounds from a hydrocarbon feedstock comprising naphtha, said process comprising:

a) sending said hydrocarbon feedstock (1) into a first fractionation unit (2) to obtain an upper stream (3) predominantly comprising C6 and C7 hydrocarbon compounds and a lower stream (9) predominantly comprising C8 to C10 hydrocarbon compounds;

b) sending the upper stream (3) into a first catalytic reforming unit (6) to obtain a first reformate effluent (8);

c) sending the lower stream (9) into a second catalytic reforming unit (12) to obtain a second reformate effluent (14);

d) combining the first reformate effluent (8) and the second reformate effluent (14) to produce a combined reformate stream (15) and sending the combined stream (15) into a recontacting section (16) to obtain a first gaseous effluent (45) rich in hydrogen and a liquid hydrocarbon effluent (46), wherein step d) comprises:

i) separating the combined reformate stream (15) into a gaseous phase (31) and a liquid phase containing hydrocarbons (32);

ii) cooling the liquid phase (32) resulting from step i) to a temperature below or equal to 45° C. by means of a cooling device (43); and iii) carrying out a first recontacting of the cooled liquid phase (32) with the gaseous phase (31) in a separator (44) to recover the first gaseous effluent (45) rich in hydrogen and the first liquid hydrocarbon effluent (46);

e) sending the first liquid hydrocarbon effluent (46) into a stabilization section (19) to recover a second gaseous effluent (52) enriched in C1 and C2 hydrocarbon compounds, a liquid phase predominantly containing C3 and C4 hydrocarbons (20) and a liquid fraction (21) predominantly comprising hydrocarbon compounds having at least four carbon atoms, wherein step e) comprises:

iv) carrying out a second recontacting of the first liquid hydrocarbon effluent (46) with a recycle gas (49) and separating the second gaseous effluent (52) enriched in C1 and C2 hydrocarbons and a second liquid hydrocarbon effluent (55);

v) fractionating the second liquid hydrocarbon effluent (55) resulting from step iv) in a fractionating column (63) to separate an overhead gaseous fraction (58) and a bottom liquid fraction (21) containing hydrocarbons having at least 4 carbon atoms; and vi) condensing the overhead gaseous fraction (58) resulting from step v) and separating the liquid phase predominantly containing C3 and C4 hydrocarbons (20) and the recycle gas (49), wherein the recycle gas is recycled to step iv), f) sending said bottom liquid fraction (21) into a reformate separation column (22) to obtain an overhead stream (23) comprising said C6-C7 aromatic hydrocarbon compounds and a bottom stream (24) comprising hydrocarbon compounds having at least eight carbon atoms, wherein, before the cooling in step ii), the liquid phase (32) resulting from step i) is precooled by heat exchange in an exchanger (39) fed with the first gaseous effluent (45) and/or the first liquid hydrocarbon effluent (46) resulting from step iii).

2. The process according to claim 1, further comprising a step g) in which the overhead stream (23) obtained in step f) is sent into a unit for extraction of the aromatics (25) in order to form a stream (26) predominantly comprising said C6-C7 aromatic compounds and a raffinate stream (27).

3. The process according to claim 2, comprising recycling said raffinate stream (27) upstream of said first catalytic reforming unit (6).

4. The process according to claim 1, in which the separator (44) is a recontacting column operating counter-currently or a scrubber.

5. The process according to claim 1, in which before the cooling in step ii), the liquid phase (32) resulting from step i) undergoes heat exchange in an exchanger (39) fed with the first gaseous effluent (45) and in which the gaseous phase (31) resulting from step i) undergoes heat exchange in an exchanger (41) fed with the first liquid hydrocarbon effluent (46).

6. The process according to claim 1, in which before the cooling in step ii), the liquid phase (32) resulting from step i) undergoes heat exchange in an exchanger (41) fed with the first liquid hydrocarbon effluent (46) and in which the gaseous phase (31) resulting from step i) undergoes heat exchange in an exchanger (41) fed with the first gaseous effluent (45).

7. The process according to claim 1, in which a portion or all of the second gaseous effluent (52) enriched in C1 and C2 hydrocarbons is recycled before the first recontacting.

8. The process according to claim 7, in which the second gaseous effluent (52) is recycled as a mixture with the gaseous phase (31) resulting from step i).

9. The process according to claim 1, in which, between a) and b), the upper stream (3) and/or the lower stream (9) are hydrodesulfurized in a hydrotreating unit (4, 10).

10. The process according to claim 1, in which the catalytic reforming b) or c) is carried out at a temperature of 400° C. to 600° C., a pressure of 0.1 to 3 MPa, a molar ratio of the hydrogen to the hydrocarbon compounds of the upper stream or the hydrocarbon compounds of the lower stream of 0.8 to 8 mol/mol, and a mass flow rate of treated stream per unit of mass of catalyst and per hour of 1 to 10 $h^{-1}$.

11. The process according to claim 1, in which the catalyst used in b) comprises an active phase comprising at least one platinum, zinc or molybdenum metal, and a support comprising a zeolite that is a zeolite L, a zeolite X, a zeolite Y or a zeolite ZSM-5, and optionally a binder that is an aluminosilicate, alumina, silica, a clays or a silicon carbide, alone or in combination.

12. The process according to claim 11, in which the zeolite is a zeolite L and the binder is silica.

13. The process according to claim 1, in which the catalyst used in c) comprises an active phase comprising at least one of nickel, ruthenium, rhodium, palladium, iridium or platinum, at least one promoter that is rhenium, tin, germanium, cobalt, nickel, iridium, rhodium or ruthenium, and a support based on alumina, on silica/alumina or on silica.

14. A process for the production of C6-C7 aromatic compounds from a hydrocarbon feedstock comprising naphtha, said process comprising:

a) sending said hydrocarbon feedstock (1) into a first fractionation unit (2) to obtain an upper stream (3) predominantly comprising C6 and C7 hydrocarbon compounds and a lower stream (9) predominantly comprising C8 to C10 hydrocarbon compounds;

b) sending the upper stream (3) into a first catalytic reforming unit (6) to obtain a first reformate effluent (8);

c) sending the lower stream (9) into a second catalytic reforming unit (12) to obtain a second reformate effluent (14);

d) combining the first reformate effluent (8) and the second reformate effluent (14) to produce a combined reformate stream (15) and processing said combined reformate stream (15) by:

(i) separating the combined reformate stream (15) into a gaseous phase (31) and a liquid phase containing hydrocarbons (32);

(ii) precooling the liquid phase (32) resulting from step i) by heat exchange in an exchanger (39) fed with a first gaseous effluent (45) and/or a first liquid hydrocarbon effluent (46) resulting from step iii), and cooling the liquid phase (32) resulting from the precooling to a temperature below or equal to 45° C. by means of a cooling device (43);

(iii) carrying out a first recontacting of the cooled liquid phase (32) with the gaseous phase (31) in a separation means (44) a first gaseous effluent (45) rich in hydrogen and a first liquid hydrocarbon effluent (46);

(e) processing the first liquid hydrocarbon effluent (46) by:

(iv) carrying out a second recontacting of the first liquid hydrocarbon effluent (46) with a recycle gas (49) and separating a second gaseous effluent (52) enriched in C1 and C2 hydrocarbons and a second liquid hydrocarbon effluent (55);

(v) fractionating the second liquid hydrocarbon effluent of (55) resulting from step (iv) in a fractionating column (63) to separate an overhead gaseous fraction (58) and a bottom liquid fraction (21) containing hydrocarbons having at least 4 carbon atoms;

(vi) condensing the overhead gaseous fraction (58) resulting from step (v) and separating a liquid phase predominantly containing C3 and C4 hydrocarbons (20) and the recycle gas (49) which is recycled to step iv);

f) sending said bottom liquid fraction (21) into a reformate separation column (22) to obtain an overhead stream (23) comprising said C6-C7 aromatic hydrocarbon compounds and a bottom stream (24) comprising hydrocarbon compounds having at least eight carbon atoms.

15. A process for the production of C6-C7 aromatic compounds from a hydrocarbon feedstock comprising naphtha, said process comprising:

a) sending said hydrocarbon feedstock (1) into a first fractionation unit (2) to obtain an upper stream (3) predominantly comprising C6 and C7 hydrocarbon compounds and a lower stream (9) predominantly comprising C8 to C10 hydrocarbon compounds;

b) sending the upper stream (3) into a first catalytic reforming unit (6) to obtain a first reformate effluent (8);

c) sending the lower stream (9) into a second catalytic reforming unit (12) to obtain a second reformate effluent (14);

d) combining the first reformate effluent (8) and the second reformate effluent (14) to produce a combined reformate stream (15) and processing said combined reformate stream (15) by:

(i) separating the combined reformate stream (15) into a gaseous phase (31) and a liquid phase containing hydrocarbons (32);

(ii) precooling the liquid phase (32) resulting from step i) by heat exchange in an exchanger (39) fed with a first gaseous effluent (45) resulting from step (iii), cooling the gaseous phase (31) resulting from step (i) in an exchanger (41) fed with the first liquid hydrocarbon effluent (46), and cooling the liquid phase (32) resulting from the precooling to a temperature below or equal to 45° C. by means of a cooling device (43);

(iii) carrying out a first recontacting of the liquid phase (32) cooled with the gaseous phase (31) in a separation means (44) recovering a first gaseous effluent (45) rich in hydrogen and a first liquid hydrocarbon effluent (46);

(e) processing the first liquid hydrocarbon effluent (46) by:

(iv) carrying out a second recontacting of the first liquid hydrocarbon effluent (46) with a recycle gas (49) and separating a second gaseous effluent (52) enriched in C1 and C2 hydrocarbons and a second liquid hydrocarbon effluent (55);

(v) fractionating the second liquid hydrocarbon effluent (55) resulting from step (iv) in a fractionating column (63) to separate an overhead gaseous fraction (58) and a bottom liquid fraction (21) containing hydrocarbons having at least 4 carbon atoms;

(vi) condensing the overhead gaseous fraction (58) resulting from step (v) and separating a liquid phase predominantly containing C3 and C4 hydrocarbons (20) and the recycle gas (49) which is recycled to step iv);

f) sending said bottom liquid fraction (21) into a reformate separation column (22) to obtain an overhead stream (23) comprising said C6-C7 aromatic hydrocarbon compounds and a bottom stream (24) comprising hydrocarbon compounds having at least eight carbon atoms.

16. A process for the production of C6-C7 aromatic compounds from a hydrocarbon feedstock comprising naphtha, said process comprising:

a) sending said hydrocarbon feedstock (1) into a first fractionation unit (2) to obtain an upper stream (3) predominantly comprising C6 and C7 hydrocarbon compounds and a lower stream (9) predominantly comprising C8 to C10 hydrocarbon compounds;

b) sending the upper stream (3) into a first catalytic reforming unit (6) to obtain a first reformate effluent (8);

c) sending the lower stream (9) into a second catalytic reforming unit (12) to obtain a second reformate effluent (14);

d) combining the first reformate effluent (8) and the second reformate effluent (14) to produce a combined reformate stream (15) and processing said combined reformate stream (15) by:

(i) separating the combined reformate stream (15) into a gaseous phase (31) and a liquid phase containing hydrocarbons (32);

(ii) precooling the liquid phase (32) resulting from step i) by heat exchange in an exchanger (41) fed with a first liquid hydrocarbon effluent (46) resulting from step (iii), cooling the gaseous phase (31) resulting from step (i) in an exchanger (41) fed with the first gaseous effluent (45), and cooling the liquid phase (32) resulting from the precooling to a temperature below or equal to 45° C. by means of a cooling device (43);

(iii) carrying out a first recontacting of the liquid phase (32) cooled with the gaseous phase (31) in a separation means (44) recovering a first gaseous effluent (45) rich in hydrogen and a first liquid hydrocarbon effluent (46);

(e) processing the first liquid hydrocarbon effluent (46) by:

(iv) carrying out a second recontacting of the first liquid hydrocarbon effluent (46) with a recycle gas (49) and separating a second gaseous effluent (52) enriched in C1 and C2 hydrocarbons and a second liquid hydrocarbon effluent (55);

(v) fractionating the second liquid hydrocarbon effluent (55) resulting from step (iv) in a fractionating column (63) to separate an overhead gaseous fraction (58) and a bottom liquid fraction (21) containing hydrocarbons having at least 4 carbon atoms;

(vi) condensing the overhead gaseous fraction (58) resulting from step (v) and separating a liquid phase predominantly containing C3 and C4 hydrocarbons (20) and the recycle gas (49) which is recycled to iv);

f) sending said bottom liquid fraction (21) into a reformate separation column (22) to obtain an overhead stream (23) comprising said C6-C7 aromatic hydrocarbon compounds and a bottom stream (24) comprising hydrocarbon compounds having at least eight carbon atoms.

* * * * *